United States Patent [19]

Schmitz et al.

[11] Patent Number: 5,035,336

[45] Date of Patent: Jul. 30, 1991

[54] COMPACT COLLAPSIBLE MANHOLE COVER LIFTER

[76] Inventors: Robert J. Schmitz, 16835 Jalisco Ter. East, Lakeville, Minn. 55044; Dean R. Quam, 1602 73rd Ave. No., Brooklyn Park, Minn. 55444

[21] Appl. No.: 476,321

[22] Filed: Feb. 7, 1990

Related U.S. Application Data

[63] Continuation-in-part of Ser. No. 279,942, Dec. 5, 1988, abandoned, which is a continuation of Ser. No. 40,031, Apr. 20, 1987, Pat. No. 4,789,072.

[51] Int. Cl.[5] ..... B66C 23/18

[52] U.S. Cl. ..... 212/166; 212/162; 212/142.1

[58] Field of Search ..... 212/166, 203, 205, 213, 212/162, 218, 219, 220, 221, 244, 254, 265, 124, 125, 140, 142.1; 414/609, 629

[56] References Cited

U.S. PATENT DOCUMENTS

| | | | |
|---|---|---|---|
| 270,675 | 1/1863 | Hunter | 212/218 |
| 422,826 | 3/1890 | Peterson | 212/218 |
| 491,933 | 2/1893 | Aiken | 212/213 |
| 903,552 | 11/1908 | Eastwood et al. | 212/221 |
| 2,068,825 | 1/1937 | Stevenson | 212/254 |
| 2,804,979 | 9/1957 | Lassiter | 212/265 |
| 3,281,880 | 11/1966 | Bender . | |
| 3,520,514 | 7/1970 | Evans | 212/218 |
| 3,572,513 | 3/1971 | Tantlinger et al. | 212/205 |
| 3,689,369 | 9/1972 | Tucker | 212/166 |
| 4,076,215 | 2/1978 | Landert . | |
| 4,157,811 | 2/1978 | Haller . | |
| 4,181,290 | 1/1980 | Affolter | 254/124 |
| 4,365,925 | 12/1982 | Girtz . | |
| 4,515,660 | 5/1985 | Kwasnik . | |
| 4,546,891 | 10/1985 | Lanigan . | |

FOREIGN PATENT DOCUMENTS

| | | | |
|---|---|---|---|
| 275559 | 5/1951 | Switzerland | 212/218 |
| 2045206 | 10/1980 | United Kingdom | 212/166 |

*Primary Examiner*—Sherman D. Basinger
*Assistant Examiner*—Stephen P. Avila
*Attorney, Agent, or Firm*—John W. Bunch

[57] ABSTRACT

A manually actuated, hydraulic manhole cover lifter (10) comprises a frame (12) mounted on wheels (58) and adapted to straddle a manhole. An actuator (30) is mounted on the frame. The actuator comprises a cylinder (36) connected to a pump (34). A magnet (50) is connected to the cylinder (36) for engagement with the metallic manhole cover. In a second embodiment, the lifter (70) includes pivotal legs (74) in order to be more compact for storage and transport. A winch (108) can be utilized instead of a pump and cylinder arrangement (34, 36), and the manhole cover can be engaged either mechanically or magnetically.

14 Claims, 4 Drawing Sheets

FIG. 1
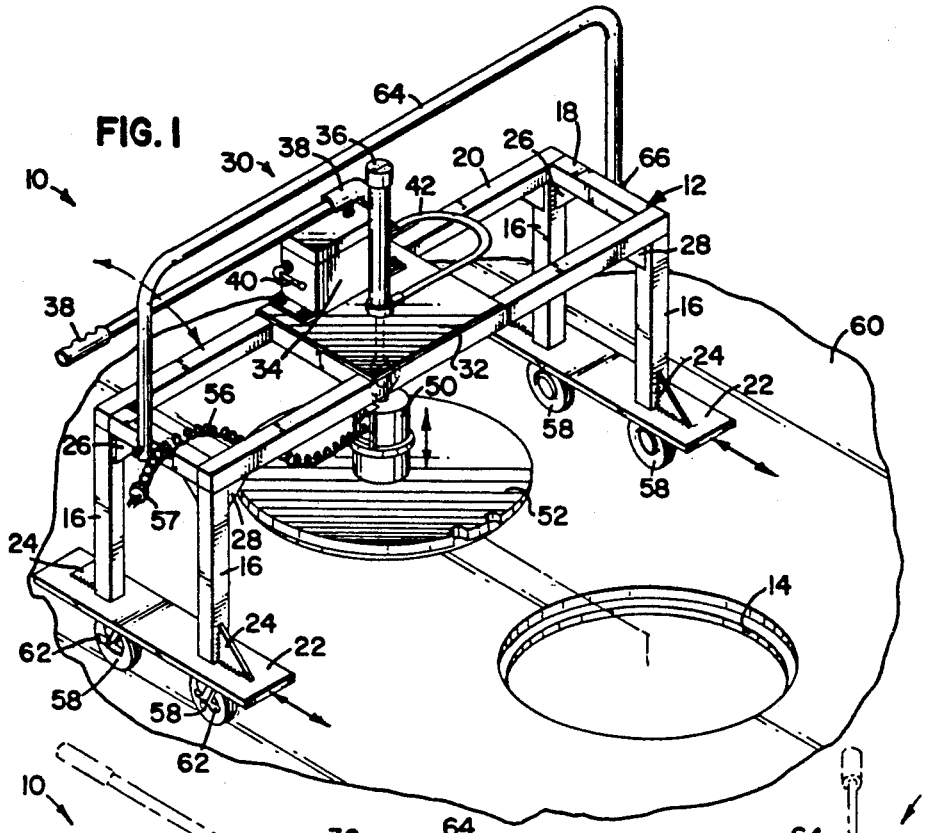
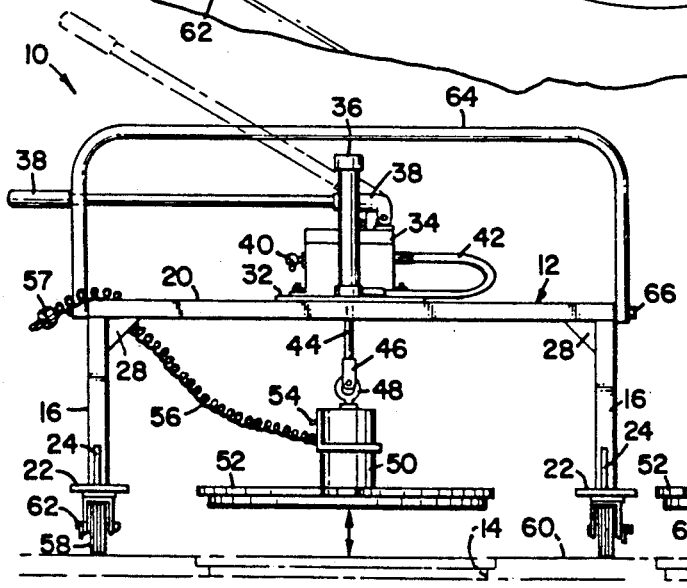
FIG. 2
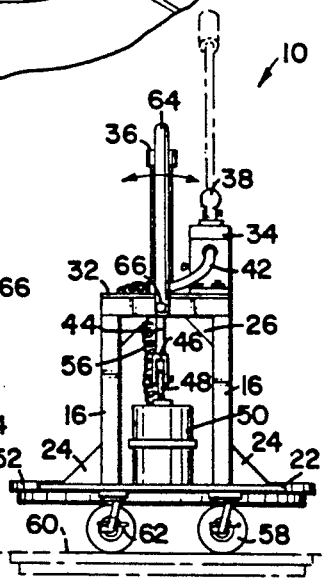
FIG. 3

COMPACT COLLAPSIBLE MANHOLE COVER LIFTER

Cross-Reference to Related Application

This is a continuation-in-part of co-pending application Ser. No. 07/279,942 filed Dec. 5, 1988, abandoned which is a continuation of application Ser. No. 07/040,031 filed Apr. 20, 1987, now U.S. Pat. No. 4,789,072.

TECHNICAL FIELD

Manhole covers are used to close manholes leading from street level down to a sewer or other utility connections. Of course, before such manholes can be entered their covers must be removed. Such covers are usually made of cast iron and tend to be difficult to handle because of their size and weight. For example, some manhole covers can weigh up to 200–300 pounds. Pick axes have typically been used to lift manhole covers. In doing so, the point of the pick ax is first inserted into a hole in the center of the manhole cover, so that it can be tilted upwardly and then carried or rolled away to expose the manhole. These manual steps must then be reversed to replace the cover. Injuries to the back, toes, hands and fingers of the workmen have not been uncommon due to the difficulties in handling heavy manhole covers.

Specialized devices have recently been developed to facilitate moving manhole covers. For example, U.S. Pat. No. 4,365,925 shows a manhole cover lifter with a lever arm including a handle at its long end and a hook at its short end, fulcrummed about a pair of wheels so that the cover can be lifted and then rolled into or out of position. U.S. Pat. No. 4,157,811 shows a device wherein the lever arm pivots about vertical as well as horizontal axes on a base positioned next to the manhole so that the cover can be rotated into and out of position while lifted. These devices are essentially levers that provide some mechanical advantage, but still require a fair amount of manual effort.

Powered devices for this purpose have also been available. For example, U.S. Pat. No. 4,181,290 shows another manhole cover lifter with an arm that pivots about a horizontal axis in a base stabilized by retractable legs, but the arm is actuated by a fluid cylinder or a hand operated cable reel on a vertical column extending upwardly from the base. The cover is secured to the arm by adjustable edge pins and a center hook. However, this device only functions to raise the cover to a vertical position adjacent to the manhole and is not adapted to facilitate positioning the cover away from the manhole. After the cover is lifted it is desirable to move it away from the hole for convenient access by workmen and/or their equipment. Aside from interfering with access to the hole, there is also the question of safety should the cover slip or the device tip over.

A need has thus arisen for an improved manhole cover lifter which is not only adapted to engage any type of metallic cover, regardless of the notches or holes therein, but which is designed to hold the cover in a minimum raised position within surrounding framework which can be rolled away from the hole and secured for maximum access and safety.

This invention comprises an improvement over an earlier version thereof shown in our previous U.S. Pat. No. 4,789,072.

BRIEF DESCRIPTION OF INVENTION

The present invention comprises an improved manhole cover lifter which overcomes the foregoing and other difficulties associated with the prior art. In accordance with the invention, there is provided a manhole cover lifter comprising a frame adapted to straddle a manhole. The frame includes opposing uprights connected by a transverse member that is preferably supported on wheels for mobility. A manually actuated cylinder is mounted on the frame, with a magnet secured to the depending end of the cylinder, for engagement with the cover. In the first embodiment, the legs or uprights are rigidly secured to the transverse member to form a rigid frame. In the second embodiment, however, the legs are pivotal so that the frame can be collapsed for transport in compact form. If desired, a winch can be used instead of a manually actuated cylinder, and a mechanical connection can be used instead of a magnet for engaging the cover.

BRIEF DESCRIPTION OF DRAWINGS

A better understanding of the invention can be had by reference to the following Detailed Description in conjunction with the accompanying Drawings, wherein:

FIG. 1 is a perspective view of the manhole cover lifter of the invention with a cover suspended therefrom, positioned away from a manhole;

FIG. 2 is a front view of the manhole cover lifter herein;

FIG. 3 is a side view thereof;

DETAILED DESCRIPTION

Figure 4:
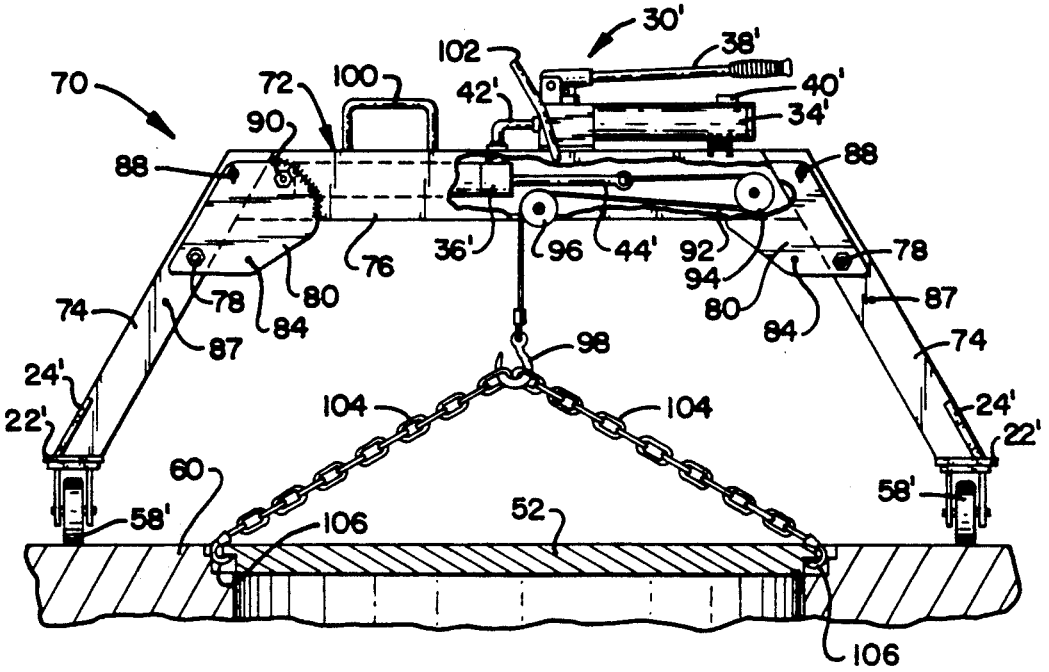
FIG. 4 is a front view of a manhole cover lifter incorporating a second embodiment of the invention herein, with the frame legs in extended position.

Referring now to the Drawings, wherein like reference numerals designate like or corresponding elements throughout the views, and particularly referring to FIGS. 1–3 there is shown a manhole cover lifter 10 incorporating the first embodiment of the invention. The lifter 10 includes a frame 12 which is adapted to straddle a manhole 14. The frame 12 includes opposing pairs of legs or upright members 16, connected at their upper ends by longitudinal top members 18 and transverse cross members 20. The frame members 16, 18 and 20 can be constructed from steel or aluminum tube stock welded together. The bottom ends of each adjacent pair of legs 16 are connected by foot plates 22. If desired, reinforcing gussets 24 can be provided between legs 16 and plates 22, gussets 26 between legs 16 and top members 18, and gussets 28 between the legs and the cross members 20. It will thus be appreciated that the frame 12 comprises a raised structure that straddles the manhole 14. For example, if the manhole 14 is about 30 inches in diameter, frame 12 can be about 36 inches wide, 12–15 inches deep, and 15–17 inches high.

An actuator 30 is mounted on a plate 32 secured between cross members 20 of the frame 12. The actuator 30 comprises a manually actuated hydraulic pump 34 connected to a cylinder 36. The pump 34 includes a handle 38 for pressurizing the fluid therein, a manual release valve 40, and a line 42 extending to the cylinder 36. Any suitable pump and cylinder can be used. For example, the Model P-51 pump from Enerpac Division of Applied Power of Butler, WI. can be used for pump 34. The Model CLH cylinder from Sheffer Corp. of Cincinnati, OH. can be used for cylinder 36.

The cylinder 36 includes a depending piston rod 44 which is connected through a clevis 46 and eye bolt 48 to a magnet 50.

As illustrated, the magnet 50 comprises an electromagnet having sufficient power to lift the iron cover 52. The magnet 50 includes an on/off switch 54 and a power cord 56 with a terminal plug 57. Any suitable electromagnet can be used. For example, the model CER-5 Walker-Bux lift magnet rated at 600 pounds from O.S. Walker Company, Inc. of Worcester, MA., can be used for magnet 50.

If desired, a permanent lift magnet can be used instead of an electromagnet. A Mighty Mite or Junior lift magnet from Creative Magnet Products of Redford, MI., could be substituted for an electromagnet.

In accordance with the preferred construction, the manhole cover lifter 10 is supported on wheels 58. The wheels 58 are preferably non-castering or swiveling wheels, so that the frame 12 can be guided along a straight line toward and away from the manhole 14 in accordance with the slope on the street surface 60 for maximum control. A lock 62 is preferably provided on each of the wheels 58. If desired, a handle 64 connected to frame 12 at pivots 66, can also be provided.

Figure 6:
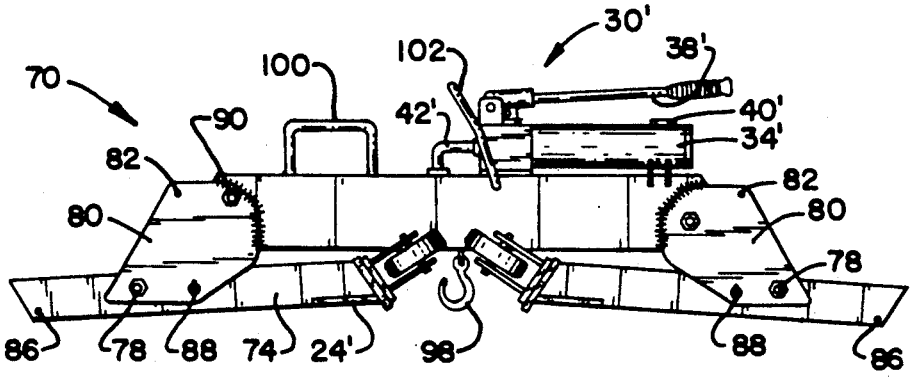
FIG. 6 is a front view thereof with the legs in retracted position.
Figure 5:
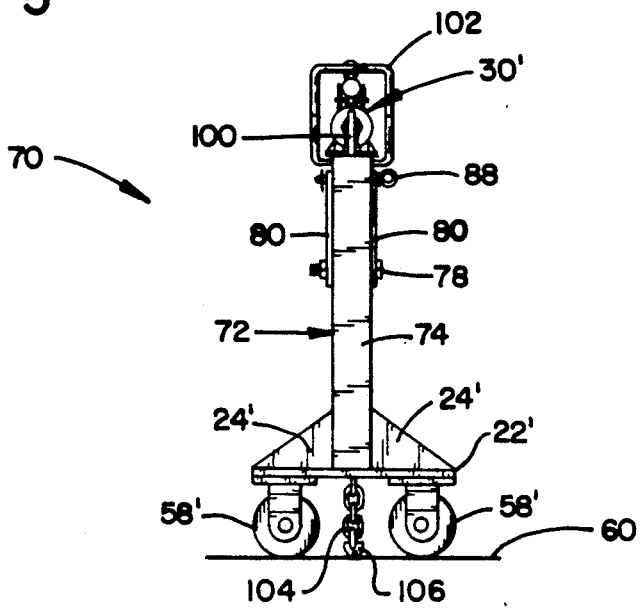
FIG. 5 is a side view thereof.

Referring now to FIGS. 4–6, there is shown a manhole cover lifter 70 incorporating a second embodiment of the invention. The lifter 70 includes several components which are substantially similar in construction and function to those in the first embodiment. Accordingly, the same reference numerals but with prime (') notations, have been utilized to identify such components.

The primary difference between the manhole cover lifters of the first and second embodiments herein comprises the fact that the lifter 70 utilizes a collapsible frame 72. The frame 72 includes a pair of opposing legs or upright members 74 pivoted at their upper ends to opposite ends of a single cross member 76. Members 74 and 76 are preferably formed from sections of channel or box stock. The upper end of each leg member 74 pivots about a fixed pin 78 extending between a pair of plates 80 which are welded to opposite sides of the top cross member 76. As illustrated, the opposite ends of the cross member 76 are angled to act as stops for the upper ends of the leg members 74. FIGS. 4 and 5 show the leg members 74 in their extended position, while FIG. 6 shows them in their retracted position for storage or transport in compact form.

The manhole cover lifter 70 preferably includes means for positively locking the leg members 74 in either position. Opposing pairs of holes 82 and 84 are provided in plates 80 for registration with holes 86 and 87 in the leg members 74 and receipt of locking pins 88. FIGS. 4 and 5 show the locking pins 88 positioned in holes 82 and 86 in order to positively retain the leg members 74 in their extended positions. FIG. 6 shows the locking pins 88 seated in holes 84 and 87 in order to positively retain the leg members 74 in their retracted position.

The actuator 30' is mounted directly on or within the frame 72 of the lifter 70. In particular, the hydraulic pump 34' is mounted on the top cross member 76. Line 42' connects the hydraulic pump 34' with cylinder 36', which is mounted inside the top cross member 76. One end of the cylinder 36' is secured to a pin or bolt 90 extending through the top cross member 76. A length of cable 92 is secured to the piston rod 44 extending from the other end of cylinder 36. The cable 92 extends from the end of piston rod 44' around pulleys 94 and 96 to a lift hook 98. The pulleys 94 and 96 are supported on bolts or pins extending through the top cross member 76 as shown.

In accordance with the preferred construction, a longitudinal handle 100 and a transverse handle 102 are secured to the top member 76 of frame 72.

The lift hook 98 can be attached to the manhole cover 52 by magnetic or non-magnetic means. As is illustrated, a plurality of chains 104 with end hooks 106 at their lower ends, extend between the central lift hook 98 and the periphery of cover 52. The lengths of chains 104 of course can be adjusted by attachment of a different link to the hook 98.

Figure 7:
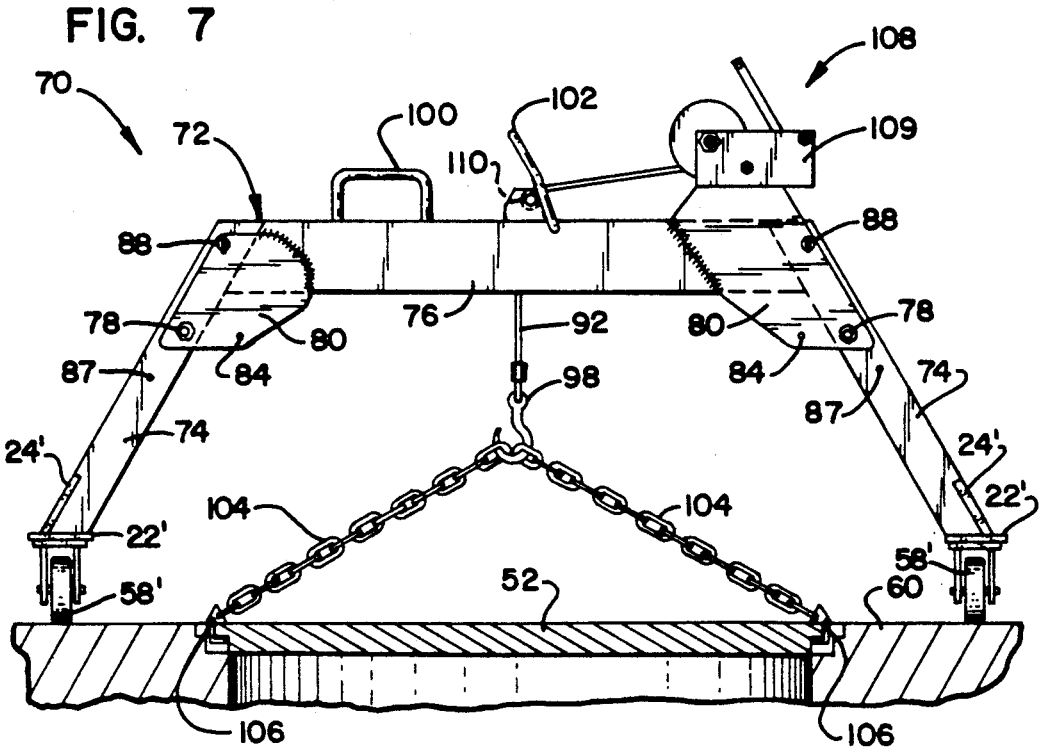
FIG. 7 is a side view of the manhole cover lifter of the second embodiment herein, modified to incorporate a manual winch.

FIG. 7 shows a modified lifter 70 incorporating a different actuator 108. Instead of a hydraulic pump and cylinder arrangement, the actuator 108 comprises a manual winch for winding or unwinding the cable 92 in order to lift or lower the hook 98 and the cover 52 suspended therefrom. The cable 92 extends over a pulley 110 rotatably supported between a pair of lugs secured to the top frame member 76 as shown. As illustrated, the winch 109 comprises a manual winch, although any suitable manual or powered winch may be utilized. A brake winch is preferable for safety purposes. Such winches can be obtained from Dutton-Lainson Company of Hastings, Nebr., for example.

Figure 8:
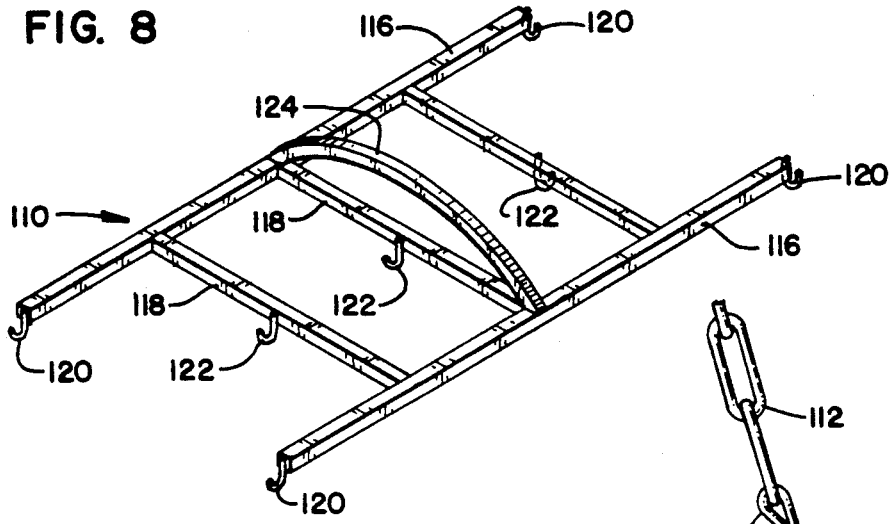
FIG. 8 is a perspective view of a frame for connection between the manhole cover lifter herein and the cover.
Figure 9:
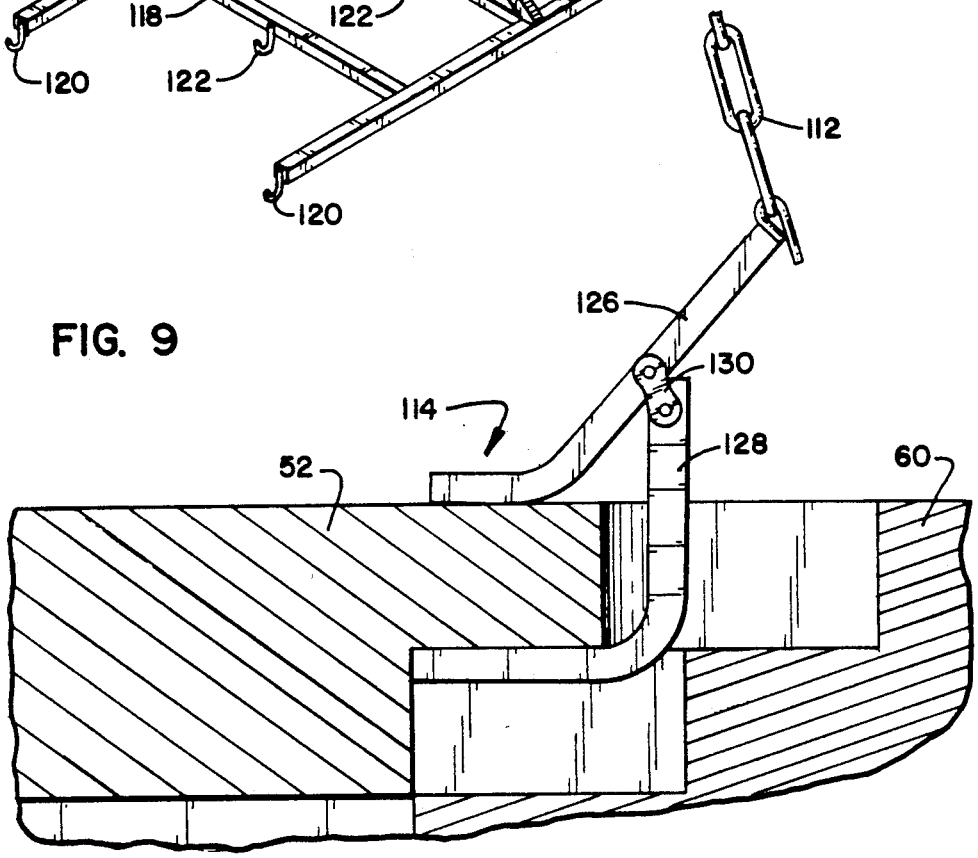
FIG. 9 is an enlarged sectional view of a mechanical connector for attachment to a cover.

FIGS. 8 and 9 show another form of mechanical attachment comprising a rigid frame 110, chains 112, and hooks 114. The frame 110 comprises a pair of side bars 116 interconnected by a plurality of crossbars 118 in order to form a symmetrical ladder-like structure. Hooks 120 are mounted on the ends of the side bars 116, and hooks 122 are centrally secured to the cross bars 118. A raised central member 124 is provided for attachment to the lift hook 98. The upper ends of chains 112 are attached to hooks 120 and 122, depending upon the particular hole and peripheral notch configuration of the manhole cover 52 being handled. The lower ends of chains 112 are secured to hooks 114, which in the preferred embodiment comprise upper and lower hook members 126 and 128 interconnected by toggle links 130. In other words, hooks 114 comprise articulated instead of fixed hooks in order to minimize possible slippage upon lifting.

Figure 10:
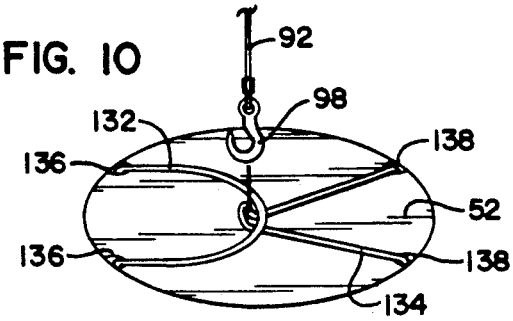
FIG. 10 is an illustration of an alternate form of mechanical connector.

FIG. 10 shows yet another form of mechanical attachment comprising two cables 132 and 134 having fixed hooks 136 and 138 at opposite ends thereof, respectively. As shown, cable 134 is looped underneath cable 132 and attached to the lift hook 98. This attachment tends to be self-adjusting and self-balancing because cables 132 and 134 slip relative to each other until they become taut as the lift hook 98 is raised.

From the foregoing, it will thus be appreciated that the present invention comprises an improved manhole cover lifter having several advantages over the prior art. The device herein can be easily positioned over a manhole cover, actuated to engage and lift the cover, and then repositioned as desired away from the manhole for maximum access with minimal manual effort. The device herein functions to lift and lower the cover vertically over minimal distance within a protective frame for improved safety. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. A portable device for handling manhole covers, comprising:

a mobile frame adapted to straddle a manhole;

said frame including a raised transverse portion having opposite ends, and a pair of spaced-apart upright portions each having top and bottom ends;

means for securing the upright portions to the ends of the transverse portion of said frame for pivotal movement about transverse axes toward and away from each other between a retracted position adjacent the transverse portion and an extended position with the top ends of the upright portions in stopped engagement with the ends of the transverse portion;

attachment means for selective engagement with the manhole cover; and lifting means mounted on the transverse portion of said frame for connection with said attachment means for selectively lifting and lowering the cover.

2. The device of claim 1, wherein said attachment means comprise:

a plurality of chains having upper and lower ends; and hooks secured to the lower ends of said chains.

3. The device according to claim 2, wherein said hooks comprise:

upper and lower hook members; and toggle link means interconnecting said hook members.

4. The device of claim 1, wherein said lifting means comprises:

a cylinder mounted on the transverse portion of said frame, said cylinder including a movable rod;

a depending lift hook;

a cable secured between the rod of said cylinder and said lift hook; and manually-actuated pump means mounted on the transverse portion of said frame for selectively supplying pressurized fluid to said cylinder in order to raise and lower said lift hook.

5. The device of claim 1, wherein said lifting means comprises:

a winch mounted on the transverse portion of said frame;

a depending lift hook; and hook interconnecting said cable and winch.

6. The device according to claim 5, wherein said winch comprises a manually actuated brake winch.

7. The device of claim 1, further including:

a handle secured to the transverse portion of said frame.

8. The device of claim 1, further including:

means for selectively securing the upright portions of said frame in at least the retracted position.

9. A portable device for handling manhole covers, comprising:

a frame adapted to straddle a manhole;

said frame including a straight raised portion having opposite ends, and a pair of spaced-apart straight upright portions each having top and bottom ends;

means for securing the upright portions to the ends of the raised portion of said frame for pivotal movement about transverse axes toward and away from each other between a retracted position adjacent the transverse portion and an extended position with the top ends thereof in stopped engagement with the ends of the transverse portion;

means including a pair of non-castering wheels secured to the bottom ends of the upright portions for supporting said frame for movement;

attachment means for selective engagement with the manhole cover; and lifting means mounted on the transverse portion of said frame for connection with said attachment means for selectively lifting and lowering the cover.

10. The device of claim 9, wherein said lifting means comprises:

a cylinder mounted on the transverse portion of said frame, said cylinder including a movable rod;

a depending lift hook;

a cable secured between the rod of said cylinder and said lift hook; and manually-actuated pump means mounted on the transverse portion of said frame for selectively supplying pressurized fluid to said cylinder in order to raise and lower said lift hook.

11. The device of claim 9, wherein said lifting means comprises:

a winch mounted on the transverse portion of said frame;

a depending lift hook; and cable interconnecting said hook and winch.

12. The device according to claim 11, wherein said winch comprises a manually actuated brake winch.

13. The device of claim 9, further including:

means for selectively securing the upright portions of said frame in at least the retracted position.

14. A portable device for handling manhole covers, comprising:

a frame adapted to straddle a manhole, said frame including a raised transverse portion having opposite ends, and a pair of spaced-apart depending upright portions each having top and bottom ends;

means for securing the upright portions to the transverse portion of said frame for pivotal movement about transverse axes toward and away from each other between a retracted position adjacent the transverse portion and an extended position with the top ends thereof in stopped engagement with the ends of the transverse portion:

means including a pair of non-castering wheels secured to the bottom ends of the upright portions for supporting said frame for movement;

attachment means for selective engagement with the manhole cover;

lifting means mounted on the transverse portion of said frame for connection with said attachment means for selectively lifting and lowering the cover; and means for selectively securing the upright portions of said frame in at least the retracted position for transport.

* * * * *